US006589872B1

(12) United States Patent
Twu et al.

(10) Patent No.: US 6,589,872 B1
(45) Date of Patent: Jul. 8, 2003

(54) USE OF LOW-HIGH SLURRY FLOW TO ELIMINATE COPPER LINE DAMAGES

(75) Inventors: Jih-Churng Twu, Chung-Ho (TW); Ying-Ho Chen, Taipei (TW); Tsu Shih, Hsin-Chu (TW); Syun-Ming Jang, Hsin-Chu (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/304,302

(22) Filed: May 3, 1999

(51) Int. Cl.[7] ..... H01K 21/20

(52) U.S. Cl. ..... 438/692; 438/690; 438/693; 438/7; 438/8; 438/720

(58) Field of Search ..... 438/691, 692, 438/693, 720, 7, 8

(56) References Cited

U.S. PATENT DOCUMENTS 5,244,534 A 9/1993 Yu et al. ..... 156/636
5,451,551 A * 9/1995 Krishnan et al. ..... 437/241
5,571,373 A * 11/1996 Krishna et al. ..... 156/636.1
5,575,885 A * 11/1996 Hirabayashi et al. .... 156/626.1
5,622,525 A 4/1997 Haisma et al. ..... 451/41
5,755,614 A 5/1998 Adams et al. ..... 451/60
5,770,095 A * 6/1998 Sasaki et al. ..... 216/38
5,863,307 A * 1/1999 Zhou et al. ..... 51/307
6,045,437 A * 4/2000 Tandon et al. ..... 451/288
6,110,648 A * 8/2000 Jang ..... 430/312
6,261,158 B1 * 7/2001 Holland et al. ..... 451/63

* cited by examiner

*Primary Examiner*—Robert Kunemund
(74) *Attorney, Agent, or Firm*—George O. Saile; Stephen B. Ackerman

(57) ABSTRACT

The invention teaches a new method of applying slurry during the process of chemical mechanical polishing of copper surfaces. By varying the rate of slurry deposition, starting out with a low rate of slurry flow that is increased as the polishing process proceeds, the invention obtains good planarity for copper surfaces while saving on the amount of slurry that is being used for the copper surface polishing process.

17 Claims, 3 Drawing Sheets

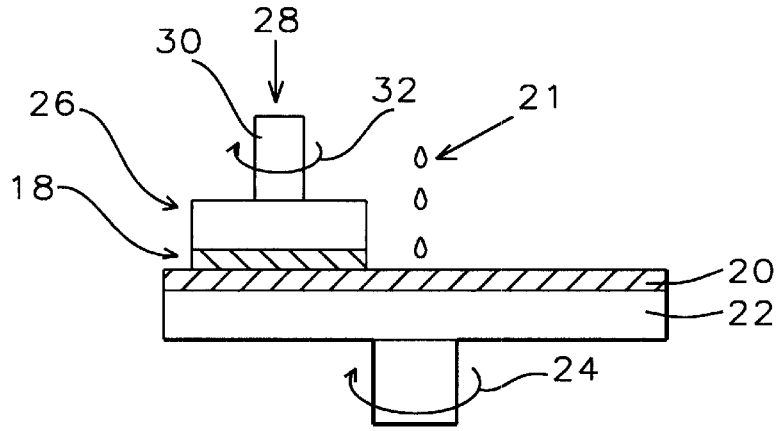
FIG. 1 – Prior Art
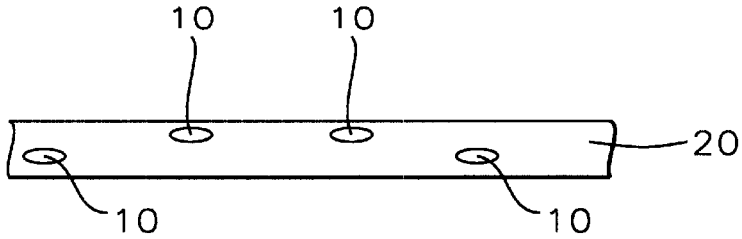
FIG. 2a – Prior Art
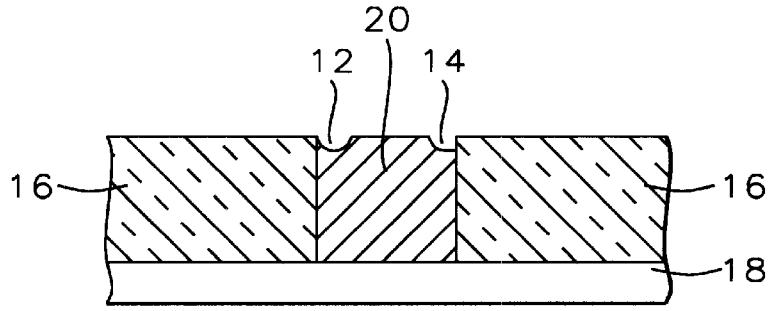
FIG. 2b – Prior Art
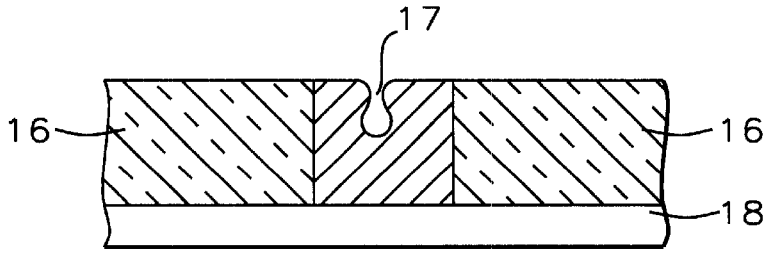
FIG. 2c – Prior Art

USE OF LOW-HIGH SLURRY FLOW TO ELIMINATE COPPER LINE DAMAGES

BACKGROUND OF THE INVENTION (1) Field of the Invention

The invention relates to the field of the fabrication of semiconductor devices, and more specifically to a method of performing Chemical Mechanical Polishing of copper lines in a damascene structure by using-a unique slurry flow.

(2) Description of the Prior Art

The present invention relates to the creation of conductive lines and vias that provide the interconnection of integrated circuits in semiconductor devices and/or the interconnections in a multilayer substrate on which semiconductor device(s) are mounted. The present invention specifically relates to the fabrication of conductive lines and vias by a process known as damascene.

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials, is maintained on the polishing pad to modify the polishing characteristics of the polishing pad in order to enhance the polishing of the substrate.

While copper has become important for the creation of multilevel interconnections, copper lines frequently show damage after CMP and clean. This in turn causes problems with planarization of subsequent layers that are deposited over the copper lines since these layers may now be deposited on a surface of poor planarity. Isolated copper lines or copper lines that are adjacent to open fields are susceptible to damage. While the root causes for these damages are at this time not clearly understood, poor copper gap fill together with subsequent problems of etching and planarization are suspected. Where over-polish is required, the problem of damaged copper lines becomes even more severe.

The increasing need to form planar surfaces in semiconductor device fabrication has led to the development of a process technology known as Chemical Mechanical Planarization (CMP). In the CMP process, semiconductor substrates are rotated, face down, against a polishing pad in the presence of abrasive slurry. Most commonly, the layer to be planarized is an electrical insulating layer overlaying active circuit devices. As the substrate is rotated against the polishing pad, the abrasive force grinds away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than to another. For example, in the presence of potassium hydroxide, silicon dioxide is removed at a faster rate than silicon nitride. The ability to control the selectivity of a CMP process has led to its increased use in the fabrication of complex integrated circuits.

U.S. Pat. No. 5,451,551 teaches that, in the evolution of integrated circuit chips, scaling down feature sizes makes device performance more heavily dependent on the interconnections between devices. In addition, the area required to route the interconnect lines becomes large relative to the area occupied by the devices. This normally leads to integrated circuit chips with multilevel interconnect schemes. The chips are often mounted on multi-chip modules that contain buried wiring patterns to conduct electrical signals between the various chips. These modules usually contain multiple layers of interconnect metalization separated by alternating layers of an isolating dielectric. Any conductor material to be used in a multilevel interconnect has to satisfy certain essential requirements such as low resistivity, resistance to electromigration, adhesion to the underlying substrate material, stability (both electrical and mechanical) and ease of processing.

Copper is often preferred due to its low resistivity, high electromigration resistance and stress voiding resistance. Copper unfortunately suffers from high diffusivity in common insulating materials such as silicon oxide and oxygen-containing polymers. For instance, copper tends to diffuse into polyimide during high temperature processing of the polyimide. This causes severe corrosion of the copper and the polyimide due to the copper combining with oxygen in the polyimide. This corrosion may result in loss of adhesion, delamination, voids, and ultimately a catastrophic failure of the component. A copper diffusion barrier is therefore often required.

The copper must also be patterned. Photolithography is a common approach wherein patterned layers are usually formed by spinning on a layer of photoresist, projecting light through a photomask with the desired pattern onto the photoresist to expose the photoresist to the pattern, developing the photoresist, washing off the undeveloped photoresist, and plasma etching to clean out the areas where the photoresist has been washed away. The exposed resist may be rendered insoluble (positive working) and form the pattern, or insoluble (negative working) and be washed away. In either case, the remaining resist on the surface forms the desired pattern. Photoresist, however, not only consumes time and resources but also endangers contamination from particulates and etchant solutions. Dry etches may also be employed in copper patterning processes employing masks. However, dry etches tend to be resisted by copper. In addition, dry etches are expensive due to the high Capitol cost reaction ion etch (RIE) systems and are limited in application because they require a hard mask such as nickel, aluminum or gold. Thus, a method of patterning copper without photolithography or dry etching is desirable. Regardless of the conductor material or patterning techniques planarization of the interlayer dielectric is crucial for obtaining a multilevel structure that allows accurate lithographic patterning. The deposition and etchback tolerances associated with large film thickness are cumulative, and any non-planarity of the resist is replicated in the final top surface of the device. Chemical-mechanical polishing is a fast and efficient approach for achieving planarity in multichip modules and integrated circuits.

FIG. 1 shows a Prior Art CMP apparatus. A polishing pad 20 is affixed to a circular polishing table 22 that rotates in a direction indicated by arrow 24 at a rate in the order of 1 to 100 RPM. A wafer carrier 26 is used to hold wafer 18 face down against the polishing pad 20. The wafer 18 is held in place by applying a vacuum to the backside of the wafer (not shown). The wafer 18 can also be attached to the wafer carrier 26 by the application of a substrate attachment film (not shown) to the lower surface of the wafer carrier 26. The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26.

A typical CMP process involves the use of a polishing pad made from a synthetic fabric and a polishing slurry, which includes pH-balanced chemicals, such as sodium hydroxide, and silicon dioxide particles.

Abrasive interaction between the wafer and the polishing pad is created by the motion of the wafer against the polishing pad. The pH of the polishing slurry controls the chemical reactions, e.g. the oxidation of the chemicals that comprise an insulating layer of the wafer. The size of the silicon dioxide particles controls the physical abrasion of surface of the wafer.

The polishing pad is typically fabricated from a polyurethane (such as non-fibrous polyurethane, cellular polyurethane or molded polyurethane) and/or a polyester based material. Pads can for instance be specified as being made of a microporous blown polyurethane material having a planar surface and a Shore D hardness of greater than 35 (a hard pad). Semiconductor polishing pads are commercially available such as models IC1000 or Scuba IV of a woven polyurethane material.

FIG. 2 shows three cross-sections of copper depositions and patterns of damage that have been observed for each of these depositions.

FIG. 2*a* shows a planar view of a copper line 20 after line deposition and line planarization. An irregular plurality 10 of surface disruptions is apparent on the surface of the copper line. These disruptions 10 are caused by surface oxidation after line polishing or by line corrosion caused by interaction of the copper with slurry chemicals during the polishing of the copper line. Experiments have indicated that the line damage that is shown is dependent on and can therefore be influenced by the rate of slurry deposition on the surface that contains the copper lines during CMP. The rate of slurry deposition is defined as the volume, expressed in cubic-centimeter (cc), of slurry deposited during a given time, or as cc/minute. Increased rate of slurry deposition results in a decrease of copper line surface damages. This experimental observation forms the basis for the invention in that the invention teaches a multi-step slurry deposition during the CMP of the copper lines whereby each step within the multi-step slurry deposition has a unique rate of slurry deposition.

FIG. 2*b* shows another form Of copper line damage or irregularity that has been observed at the completion of the CMP of copper line 20. Copper line 20 is deposited on the surface of substrate 18. Area 12 is a hollowing out of the copper surface at the edge of the surface of the copper line 20 where this edge interfaces with the surrounding dielectric 16. This hollowing out has the profile of a semi-circle. Another irregularity is highlighted with 14, this irregularity also occurs on the surface of the copper line 20 where this line interfaces with the surrounding dielectric 16. This irregularity 14 has a sloping profile with the lowest point of the slope being at the sidewall of the opening that was created for the deposition of the copper line 20.

FIG. 2*c* shows yet another irregularity 17 that is typical and has been observed in the surface of the polished copper line 20. This irregularity 17 is typically referred to as a keyhole opening if the irregularity extends over a limited or concentrated section of the surface of the copper line 20. This surface irregularity can however also extend over a larger section of the surface of the copper line 20 and can, in this extension, follow the direction of a deposited copper line 20 over a considerable distance. In this case the irregularity is referred to as a surface seam in the copper line 20.

U.S. Pat. No. 5,770,095 (Sasaki et al.) teaches a 2 step CMP using different polishing slurries and temperatures.

U.S. Pat. No. 5,244,534 (Yu et al.) shows a 2-step CMP process for W plugs.

U.S. Pat. No. 5,755,614 (Adams et al.) teaches a, recycled slurry process to save slurry. However, this reference differs from the invention.

U.S. Pat. No. 5,863,307 (Zhou et al.) composition. teaches a Cu CMP slurry composition.

U.S. Pat. No. 5,622,525 (Haisma et al.) teaches a Cu CMP method using an alkaline solution.

SUMMARY OF THE INVENTION

It is the primary objective of the invention to provide a method for planarizing copper lines without incurring damage to those lines.

It is another objective of the invention to reduce the amount of slurry used during the polishing process for copper lines and thereby reduce overall manufacturing cost.

In accordance with the objectives of the invention, the invention teaches a new method of supplying slurry during the process of chemical mechanical polishing of copper lines. By varying the rate of slurry deposition, starting out with a low rate of deposition that is increased as the polishing process proceeds, the invention obtains good planarity for copper lines while saving on the amount of slurry that is being used for the polishing process.

BRIEF DESCRIPTION OF THE DRAWINGS

FIG. 1 shows a Prior Art wafer polishing apparatus.

FIG. 2 shows problems encountered with copper line depositions.

DETAILED DESCRIPTION OF THE PREFERRED EMBODIMENT

Figure 3A:
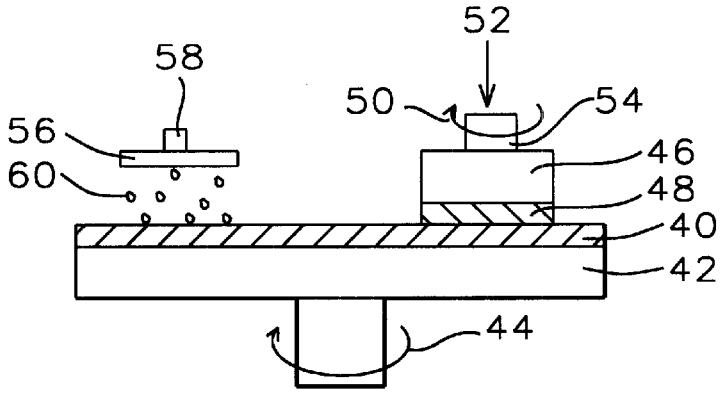
FIG. 3 shows a slurry distribution system of the invention.

Referring now specifically to FIG. 3, there is shown a cross section of a polishing apparatus that can be used to implement the slurry distribution scheme of the invention.

A polishing pad 40 is affixed to a circular polishing table 42 that rotates in a direction indicated by arrow 44 at a rate in the order of 1 to 100 RPM. A wafer carrier 46 is used to hold wafer 48 face down against the polishing pad 40. The wafer 48 is held in place by applying a vacuum to the backside of the wafer (not shown). The wafer 48 can also be attached to the wafer carrier 46 by the application of a substrate attachment film (not shown) to the lower surface of the wafer carrier 46. The wafer carrier 46 also rotates as indicated by arrow 50, usually in the same direction as the polishing table 42, at a rate on the order of 1 to 100 RPM. Due to the rotation of the polishing table 42, the wafer 48 traverses a circular polishing path over the polishing pad 40.

A force 52 is also applied in the downward vertical direction against wafer 48 and presses the wafer 48 against the polishing pad 40 as it is being polished. The force 48 is typically in the order of 0 to 15 pounds per square inch and is applied by means of a shaft 54 that is attached to the back of wafer carrier 46.

Slurry 60 is distributed over the surface of the polishing pad 40 via a slurry distribution head 56; the slurry is supplied by means of the supply feed tube 58. This supply feed tube 58 is attached to a slurry supply reservoir (not shown) from where the slurry can be fed to the slurry distribution head 56 at different rates of flow and under varying conditions of pressure applied to the slurry 60. As a further variation of the method of distributing the slurry over the surface of the polishing pad 40, the plane of the slurry distribution head 56 can be under an angle with the plane of the wafer thus further enhancing the even distribution of the slurry over the surface of the wafer. The slurry distribution head 56 can further be equipped with one or multiple openings for the slurry to be dispensed through and onto the surface of the wafer further resulting in a spray of slurry of controllable density from a very coarse or drop-like slurry distribution to a very fine or mist-like slurry distribution.

Figure 3B:
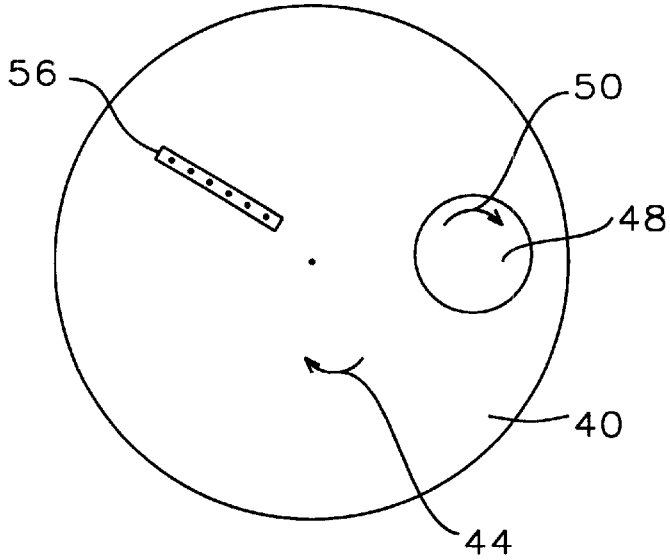

FIG. 3*b* shows a planar view of the orientation of the slurry distribution head 56 with respect to the polishing pad 40 and the wafer 48. The wafer rotates in direction 50, the polishing pad rotates in direction 44. The orientation of the slurry distribution head 56 together with the length of the slurry distribution head, combined with the previously highlighted aspects of the construction and positioning of the slurry distribution head and the method of slurry delivery, determine the manner and density with which the slurry will be deposited on the surface of the wafer.

The invention teaches different slurry flow rates; the main slurry rates of the invention are as follows:

A low-flow rate which is a slurry flow rate of less than or equal to 200 cc/min.

A high-flow rate which is a slurry flow rate of more than or equal to 250 cc/min.

The indicated slurry rates can readily be extended to slurry rates that have a pattern of slurry release that is unique and well defined for a particular slurry distribution system. The slurry distribution can, for instance, be provided in multiple steps of slurry pressure increase after which the slurry pressure rapidly decreases (in one step or in multiple steps) to its original value after which the multiple step increase in distributed slurry pressure is again initiated. Another pattern of slurry distribution can be a pattern whereby the slurry pressure pulsates between a high and a low value, the rate of pulsation can thereby also be varied and be one of the parameters that optimizes slurry distribution and subsequent polishing results. Yet another scheme of adjusting the slurry pressure is to gradually and as a linear function of time increase the slurry pressure, reset the slurry pressure to its initial value after this pressure has reached a high pressure threshold and restart the gradual increase in slurry pressure.

The invention further teaches the use of slurry as being $Al_2O_3$ or water or inhibitors or chemicals or oxidizers.

FIG. 4 shows the polishing process of the invention where the slurry low-flow rate is first less than or equal to 200 cc/min. after which a high-flow rate of more than or equal to 250 cc/min is applied.

The polishing process is broken down into two distinct steps.

The first step of the polishing process is a slow slurry flow, that is less than or equal to 200 cc/min. This polishing step is executed for a time approximately equal to 5 minutes and is determined by the thickness of the layer of copper that needs to be polished. As a for instance, if a layer of about 15 K-Angstrom is to be removed, the polishing time is to be about 5 minutes. If a layer of about 20 K-Angstrom is to be removed, the polishing time is to be about 6 minutes. This polishing process and the time of duration for this process assumes the use of standard copper slurry.

The second step of the polishing process is a high slurry flow, that is more than or equal to 250 cc/min. This polishing step is executed for a time approximately equal to 1 to 2 minutes and is again determined by the thickness of the layer of copper that needs to be polished. As a for instance, if a layer of about 1 K-Angstrom is to be removed, the polishing time is to be about 1.0 minutes. If a layer of about 2 K-Angstrom is to be removed, the polishing time is to be about 1.5 minutes. If a layer of about 4 K-Angstrom is to be removed, the polishing time is to be about 2.0 minutes. This polishing process and the time of duration for this process assumes the use of standard copper slurry.

Figure 4A:
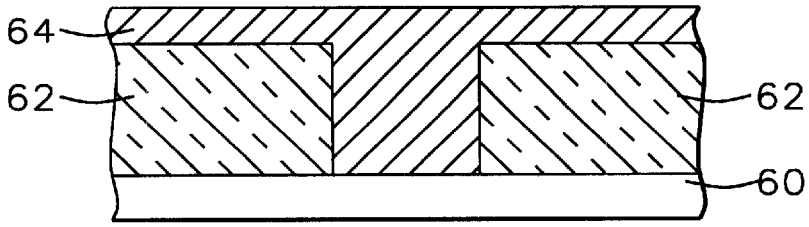
FIG. 4 shows a cross section of copper lines polished in accordance with the invention.

FIG. 4*a* shows the results obtains after the first (the low slurry flow rate) of the above highlighted two polishing steps have been completed. The copper layer 64 has been deposited over the pattern formed in the intra-level dielectric 62 on the surface of substrate 60. It is clear from FIG. 4*a* that a layer of copper remains on top of the intra-level dielectric 16 and that the process of polishing the copper line is not complete.

Figure 4B:
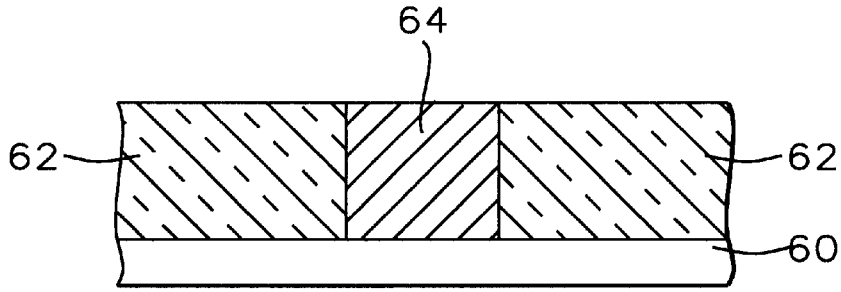

The results of the second step (the high slurry flow rate) in the above highlighted polishing process of the invention are indicated in FIG. 4*b*. It is clear from the cross section shown in FIG. 4*b* that the top surface of the copper line 64 is planar and does not further contain any of the previously observed irregularities in the surface of the copper line 64.

FIG. 5 shows a further extension of the invention in showing flow rates that are varied in accordance with fixed and predetermined patterns.

Figure 5A:
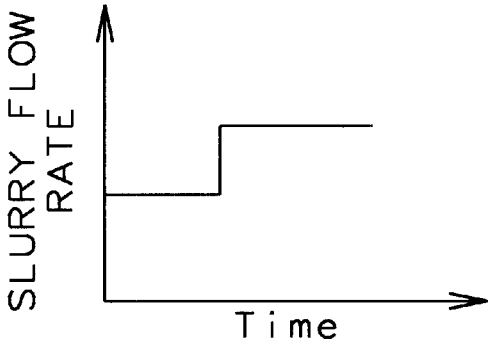
FIG. 5 shows graphic depictions of possible slurry flows as a function of time.

FIG. 5*a* shows a one step functional variation of the slurry flow rate whereby the initial slurry flow rate is low. The slurry flow rate is increased as a step function sometime during the CMP process.

Figure 5B:
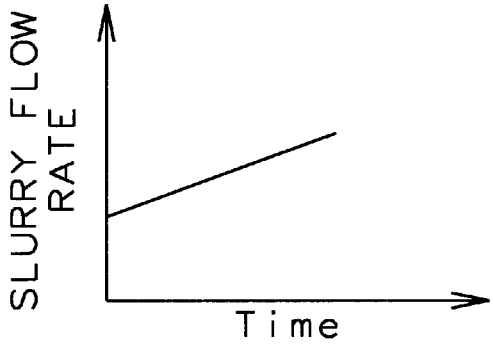

FIG. 5*b* shows a linear and gradual increase of the slurry flow rate. The slurry flow rate starts out at a low rate of flow and increases as a linear function of time during the CMP process.

Figure 5C:
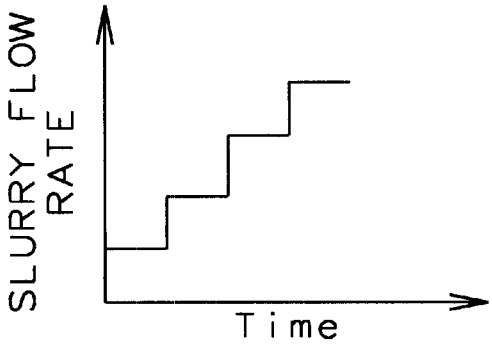

FIG. 5*c* shows a multi-step variation of the slurry flow rate. The slurry flow rate again starts out at a low value and increases, during the process of CMP, in multiple steps as a function of time. The number of step function increases that are in effect during the complete process of copper line CMP can be experimentally determined and again have as object to improve copper line planarization while reducing the amount of slurry that is used during the overall CMP process.

Figure 5D:
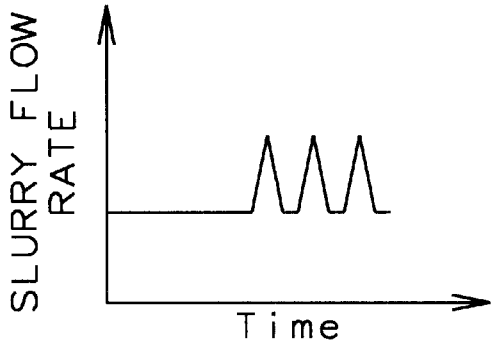

FIG. 5*d* shows a pulsating variation of the slurry flow rate. The initial slurry flow rate is low; the effect of the pulsating function of the slurry flow rate is that the average flow rate is increased during the time that the pulsating flow rate is applied. This again has the effect of increasing the slurry flow rate while the CMP process progresses thereby improving copper line planarity while reducing the amount of slurry that is used for the overall process of polishing the copper lines.

The variations in slurry distribution flow rate as shown in FIG. 5 result in the same beneficial reduction of damage to the surface of the copper lines after copper line polishing as indicated by the two step variation of the slurry flow rate that has been highlighted herein.

It will be apparent to those skilled in the art, that other embodiments, improvements, details and uses can be made consistent with the letter and spirit of the present invention and within the scope of the present invention, which is limited only by the following claims, construed in accordance with the patent law, including the doctrine of equivalents.

What is claimed is:

1. A method of polishing semiconductor surfaces, said surfaces containing copper line depositions, comprising:

providing a semiconductor substrate, said semiconductor substrate containing a pattern of copper deposition;

providing a chemical mechanical polishing apparatus; and providing a method for controlling rate of slurry flow to said chemical mechanical polishing apparatus, said rate of slurry flow being a step function as a function of time comprising two rates of slurry flow, said two rates of slurry flow being a first rate of slurry flow and a second rate of slurry flow, said first rate of slurry flow being a low rate of slurry flow, said low rate of slurry flow extending over a time for a low rate of slurry flow, said second rate of slurry flow being a high rate of slurry flow, said high rate of slurry flow extending over a time for a high rate of slurry flow, total time of application of said rate of slurry flow being time required to complete polishing said copper deposition on said semiconductor substrate.

2. The method of claim 1, said low rate of slurry flow being within a range between about 150 and 250 cc per minute, said time for said low rate of slurry flow being within a range between about 3 and 7 minutes.

3. The method of claim 1, said high rate of slurry flow being within a range between about 200 and 300 cc per minute, said time for the high rate of slurry flow being within a range between about 0.5 and 4 minutes.

4. A method of polishing semiconductor surfaces, said surfaces containing copper line depositions, comprising:

providing a semiconductor substrate, said semiconductor substrate comprising a pattern of copper deposition;

providing a chemical mechanical polishing apparatus; and providing a method for controlling rate of slurry flow to said chemical mechanical polishing apparatus, said rate of slurry flow being a Linear function of time, said function being in effect during time of application of said rate of slurry flow, said slurry flow increasing linearly as a function of time from an initial low value to a final high value, said time of application of said rate of slurry flow being time required to complete polishing said copper deposition on said semiconductor substrate, said slurry flow being expressed in cc/minute.

5. The method of claim 4, said initial low value of said rate of slurry flow being about 150 cc per minutes, said time during which said rate of slurry flow is in effect being about ten minutes.

6. The method of claim 4, said final high value of said rate of slurry flow being a rate of slurry flow of about 300 cc per minute, said total elapsed time during which said rate of slurry flow is in effect being about ten minutes.

7. A method of polishing semiconductor surfaces, said surfaces containing copper line depositions, comprising:

providing a semiconductor substrate, said semiconductor substrate comprising a pattern of copper deposition;

providing a chemical mechanical polishing apparatus; and providing a method for controlling rate of slurry flow to said chemical mechanical polishing apparatus, said rate of slurry flow as a function of time being a multi-step step function increasing from an initial low value of slurry flow to a final high value of slurry flow, said multi-step step function being in effect over time of application of said rate of slurry flow, said time of application of said rate of slurry flow being time required to complete polishing said copper deposition on said semiconductor substrate.

8. The method of claim 7, said multi-step function comprising between about 3 and 10 steps of either equal or different magnitude, said steps being performed within said time of application of said slurry flow.

9. The method of claim 7, said initial low value of said rate of slurry flow being within a range between about 150 and 250 cc per minutes.

10. The method of claim 7, said final high value of said rate of slurry flow being within a range between about 200 and 300 cc per minutes.

11. The method of claim 7, said time of the application of said slurry rate being within a range between 0.5 and 11 minutes.

12. A method of polishing semiconductor surfaces, said surfaces containing copper line depositions, comprising:

providing a semiconductor substrate, said semiconductor substrate comprising a pattern of copper deposition;

providing a chemical mechanical polishing apparatus; and providing a method for controlling rate of slurry flow to said chemical mechanical polishing apparatus, said rate of slurry flow as a function of time being a combination of a constant and a pulsating rate of slurry flow, said rate of slurry flow being in effect over time of application of said rate of slurry flow, said function comprising an initial constant rate of slurry flow, a pulsating rate of slurry flow replacing said constant rate of current flow, said pulsating rate of slurry flow fluctuating between an amplitude of a high and a low value of slurry flow, said pulsating rate occurring at a known rate of repetition, an average of said amplitude of said pulsating rate of slurry flow being higher than said initial constant rate of slurry flow by a measurable amount, said time of application of said rate of slurry flow being time required to complete polishing said copper deposition on said semiconductor substrate.

13. The method of claim 12, said initial constant rate of slurry flow being within a range between 150 and 250 cc per minute.

14. The method of claim 12, said average of the pulsating rate of slurry flow being within a range between 200 and 300 cc per minute.

15. The method of claim 12, the amplitude of said pulsating rate of slurry flow being within a range between 50 and 150 cc per minute.

16. The method of claim 12, said initial constant rate of slurry flow being in effect over a period of time within a range of between about 0.25 and 0.75 of time of application of said rate of slurry flow at the expiration of which time said pulsating rate of slurry flow taking effect.

17. The method of claim 12, the rate of repetition of said pulsating function extending between about 0.25 and 0.75 of the time of the application of said rate of slurry flow, said rate of repetition having a frequency of repetition between about 3 and 10 repetitions within the time of application of said rate of slurry flow.

* * * * *